US007735497B2

(12) United States Patent
Kim

(10) Patent No.: US 7,735,497 B2
(45) **Date of Patent: *Jun. 15, 2010**

(54) HAIR CLIP

(76) Inventor: Chan Soo Kim, 320-0 Wolgve 4-dong, Seoul (KR)

( * ) Notice: Subject to any disclaimer, the term of this patent is extended or adjusted under 35 U.S.C. 154(b) by 134 days.

This patent is subject to a terminal disclaimer.

(21) Appl. No.: 11/998,922

(22) Filed: Dec. 3, 2007

(65) Prior Publication Data

US 2008/0083422 A1 Apr. 10, 2008

Related U.S. Application Data

(62) Division of application No. 11/519,628, filed on Sep. 12, 2006, now Pat. No. 7,461,662.

(51) Int. Cl.
*A45D 8/00* (2006.01)
*A45D 8/20* (2006.01)

(52) U.S. Cl. ..... 132/276; 132/277; 132/273

(58) Field of Classification Search ..... 132/277–279, 132/276, 280–284

See application file for complete search history.

(56) References Cited

U.S. PATENT DOCUMENTS 304,634 A 9/1884 Gaillac
885,026 A 4/1908 Dodge
2,166,533 A 7/1939 Oettel
D493,013 S 7/2004 Stachowski
7,461,662 B2 * 12/2008 Kim ..... 132/277

FOREIGN PATENT DOCUMENTS

KR 20-0373108 1/2005

OTHER PUBLICATIONS

Magicionic, Advertising flyer for "Magic Jaws" product of Magic Ionic Co., Inc., Cypress, CA, undated, 2 pages.

* cited by examiner

*Primary Examiner*—Robyn Doan
(74) *Attorney, Agent, or Firm*—J. Bennett Mullinax, LLC

(57) ABSTRACT

A hair clip is provided. The hair clip has a lower clip piece and an upper clip piece connected through a pivot connection with a hinge pin and coil spring. The upper clip piece has a bottom portion that defines a concavity portion for defining a hair holding space to hold hair in a bundled state. A finger is connected to the upper clip piece through a pivot connection and for holding hair in a bundled state. A guide loop is connected to a rear end portion of the finger through a pivot connection. The guide loop prevents hair from entering a joint portion defined by the finger and the upper clip piece.

14 Claims, 7 Drawing Sheets

[Fig1]
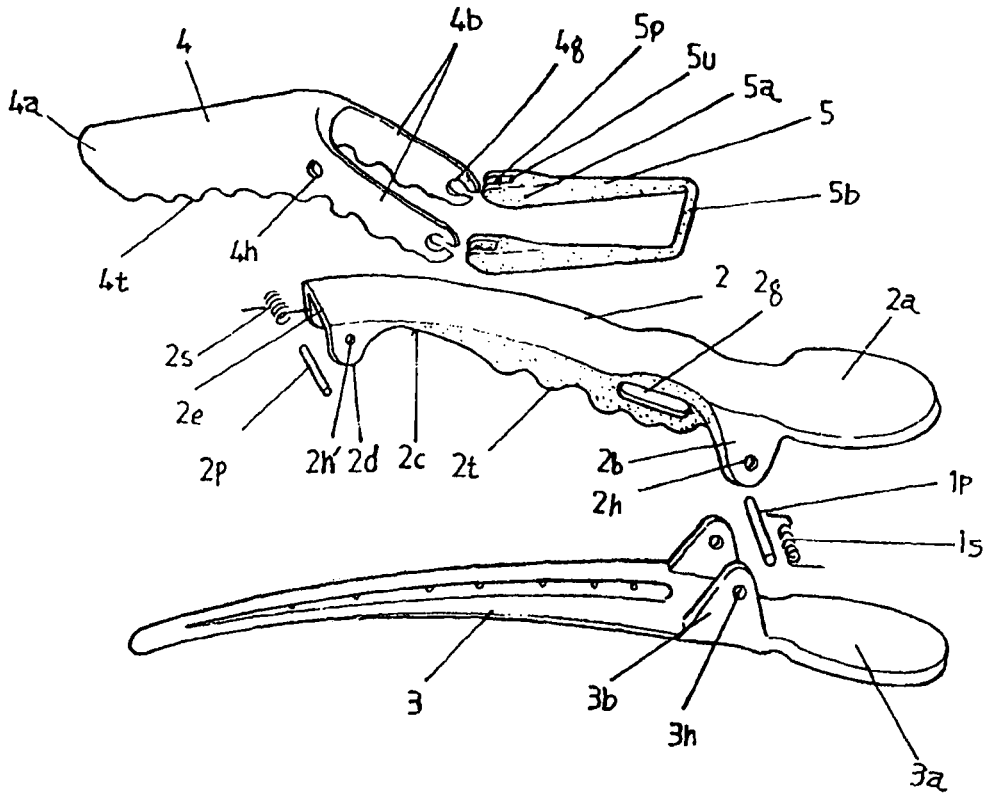

[Fig]a]
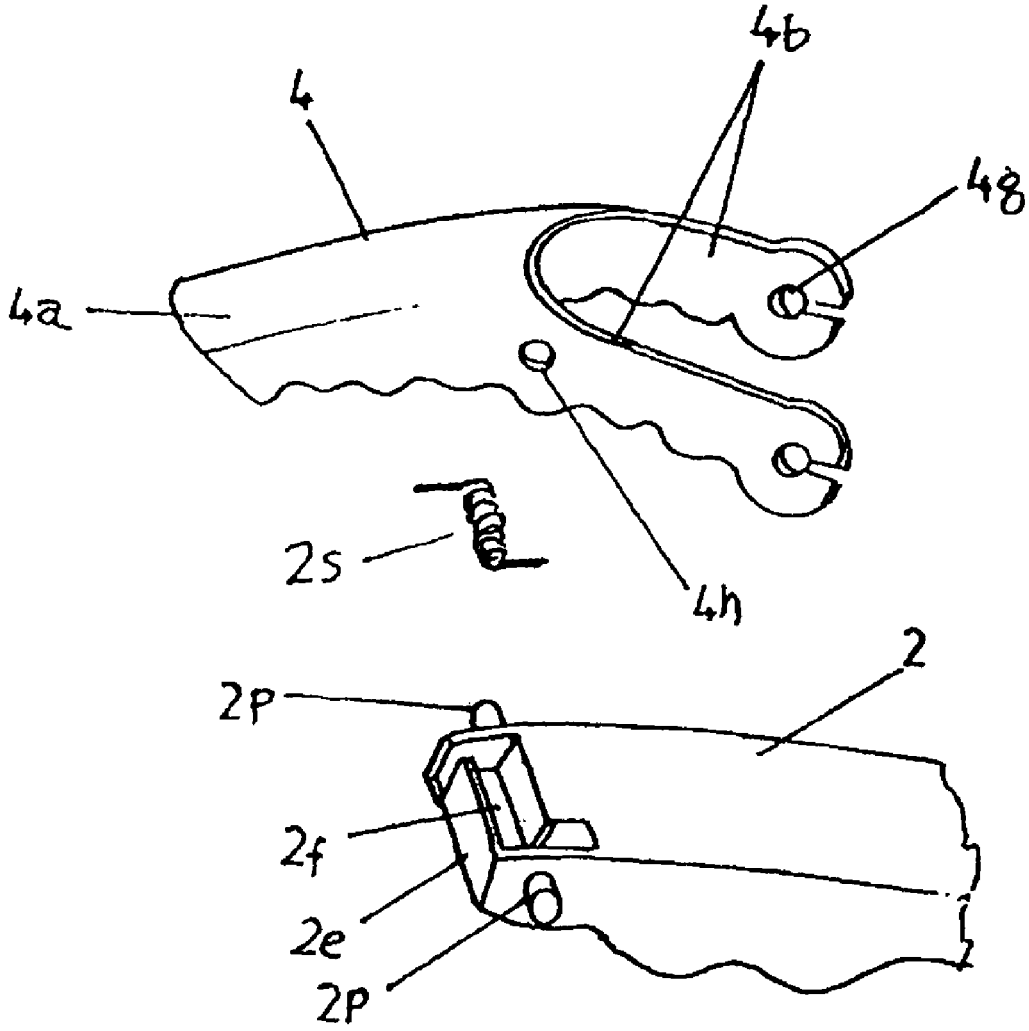

[Fig1b]
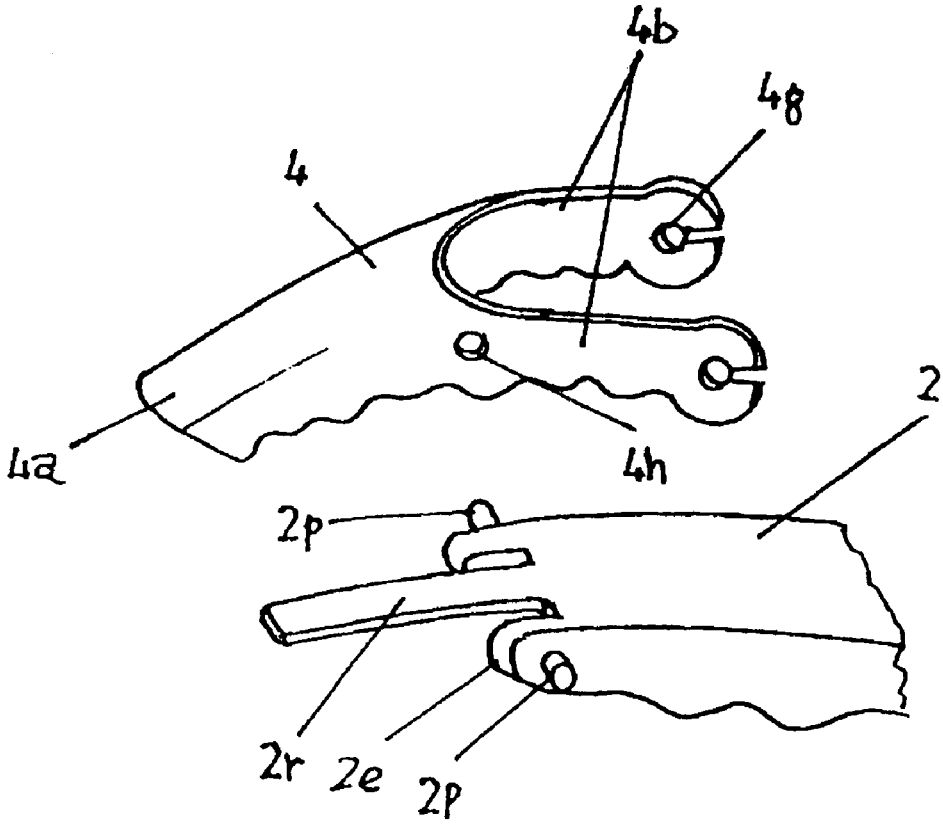

[Fig2]
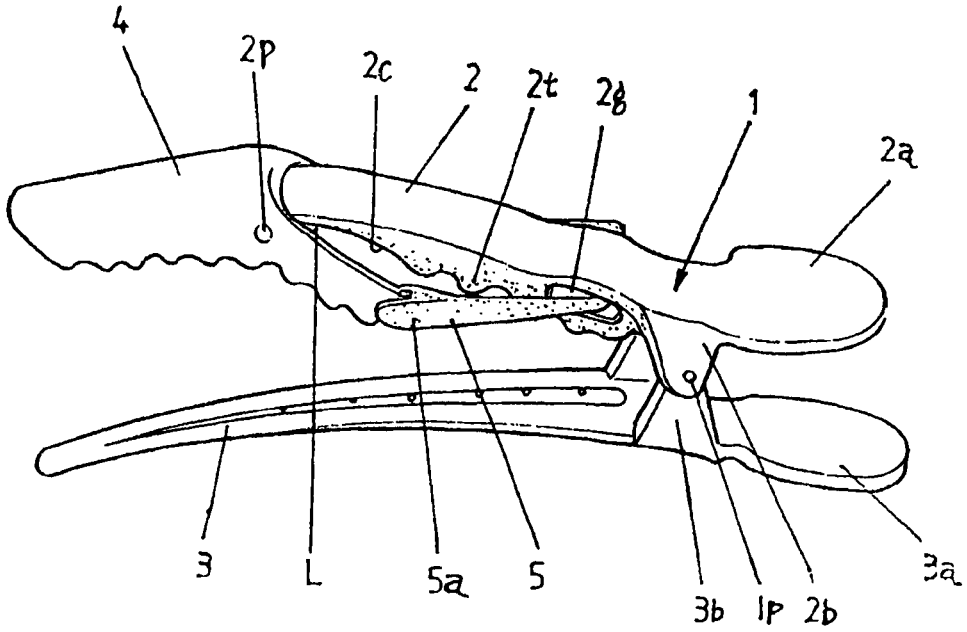
[Fig3]
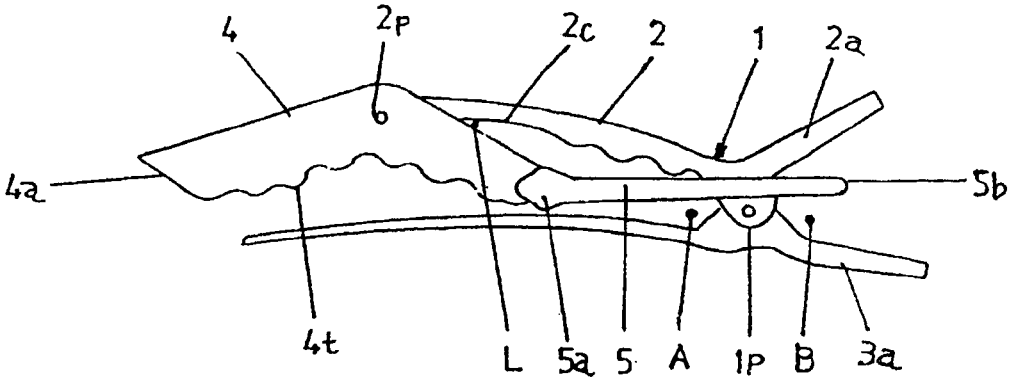

[Fig4]
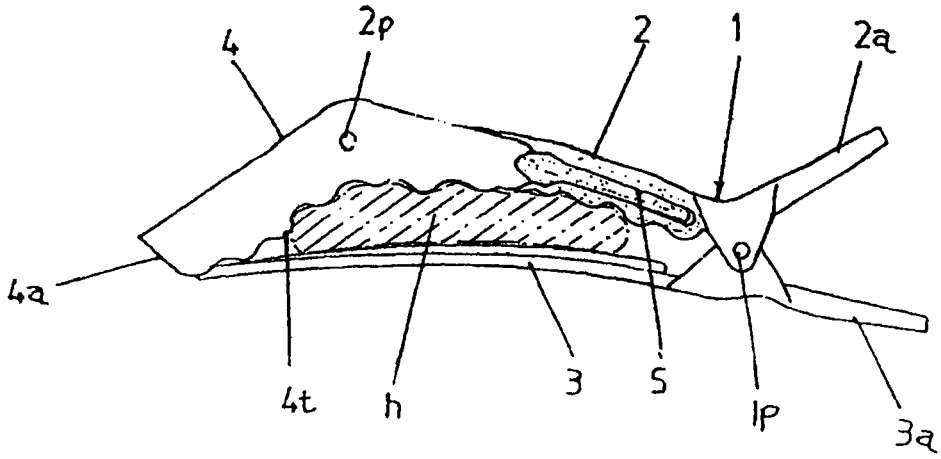
[Fig5]
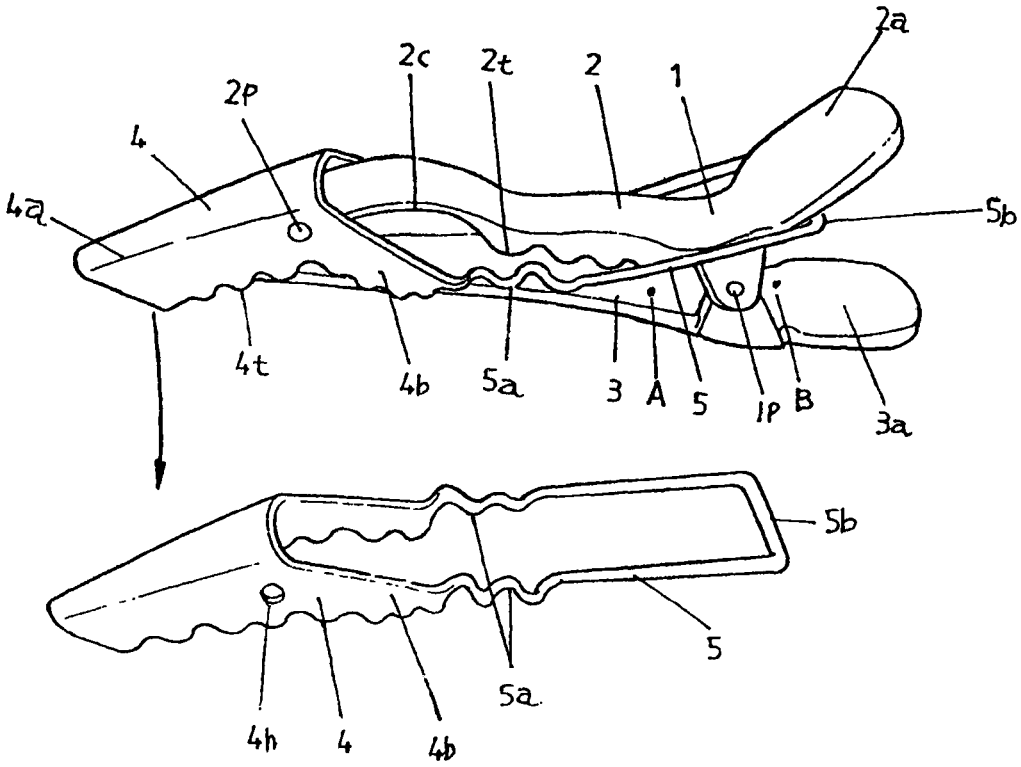

[Fig6]
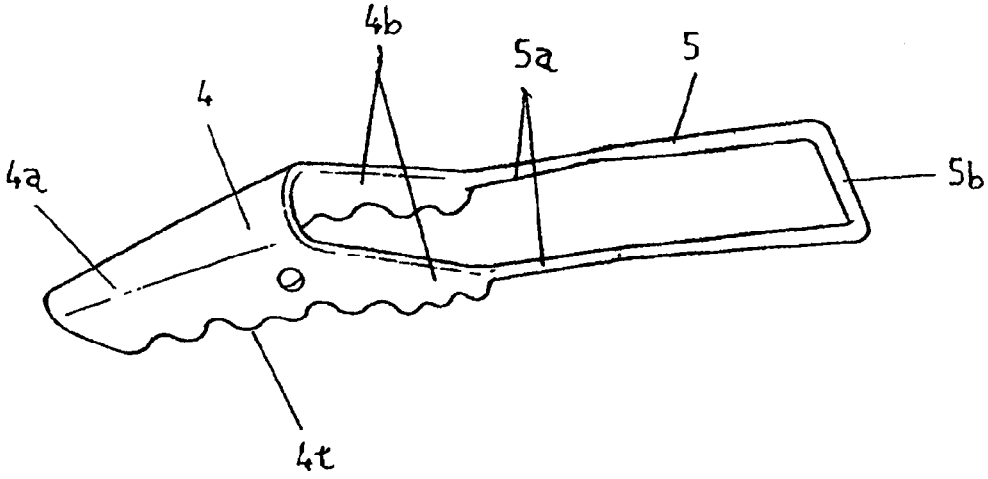
[fig7]
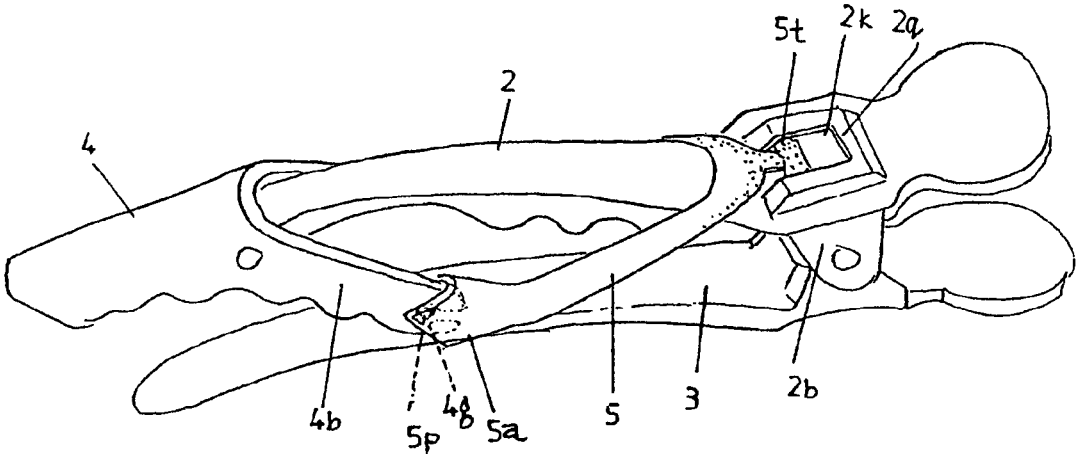

[fig8]
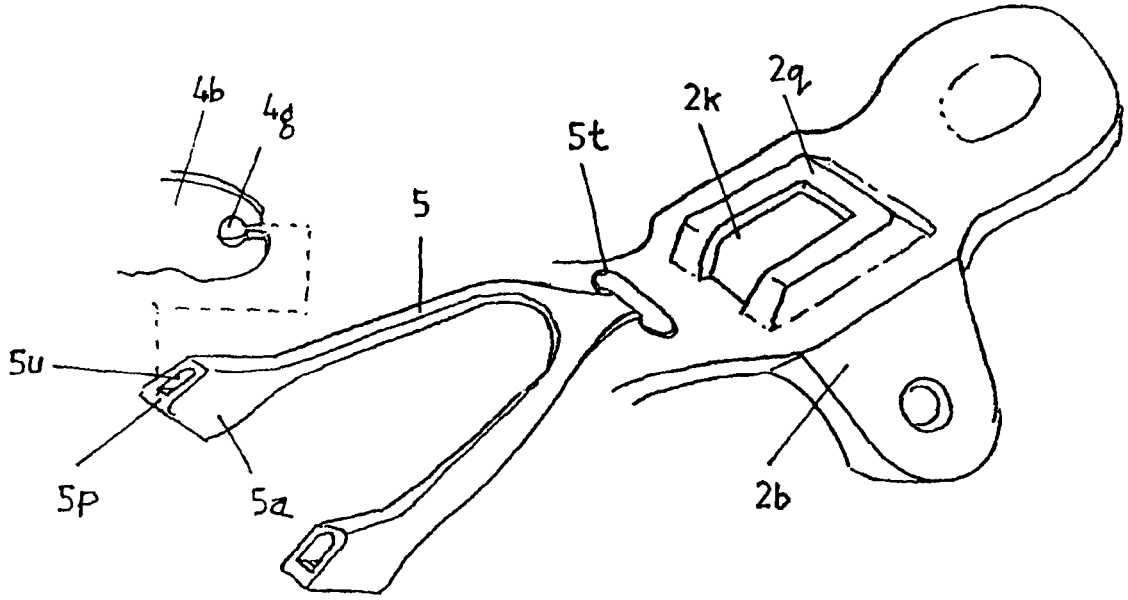

HAIR CLIP

CROSS-REFERENCE TO RELATED APPLICATIONS

The present application is a divisional application of U.S. patent application Ser. No. 11/519,628 filed on Sep. 12, 2006 whose inventor is Chan Soo Kim. U.S. application Ser. No. 11/519,628 is incorporated by reference herein in its entirety for all purposes.

FIELD OF THE INVENTION

The present invention relates generally to hair clips. More particularly, the present application involves a hair clip with a finger that allows the hair of the user to be clipped in a gathered or bundled manner.

BACKGROUND

Hair pins and hair clips are used by women to fix their hair in a desired style to maintain beauty. In general, a hair clip is assembled by a pair of clip pieces through brackets with a pin and a coil spring. If a pressing plate is pressed, the upper and lower clip pieces are opened, and if the pressing plate is released, the upper and lower clip pieces clip the hair as the upper and the lower clip pieces are pressed against each other by the elasticity of the spring.

However, the pair of clip pieces are long and narrow and are slightly curved as they form a lever with a connecting pin as a supporting point. The hair is clipped fairly firmly near the area of the clip pieces close to the connecting pin, but the hair is not likely to be clipped firmly enough in the area of the clip pieces away from the connecting pin and toward the free end of the clip pieces. In this regard, the elastic force of the spring deteriorates in this area. Furthermore, this conventional type of hair clip cannot clip the hair in a gathered or in a bundled form. Besides, if the person moves her head, the hair clips are likely to fall off easily from the hair, affecting safety during use. As such, there remains room for variation and improvement within the art.

SUMMARY

Various features and advantages of the invention will be set forth in part in the following description, or may be obvious from the description, or may be learned from practice of the invention.

One aspect of the present invention provides for a hair clip that includes a lower clip piece and an upper clip piece connected through a pivot connection that has a hinge pin and a coil spring. The upper clip piece has a bottom portion that defines a concavity portion for use in defining a hair holding space to hold the hair of a user in a bundled state. A finger is connected to the upper clip piece through a pivot connection and is used to hold the hair of a user in a bundled state. A guide loop is connected to a rear end portion of the finger through a pivot connection. The guide loop prevents hair from entering a joint portion defined by the finger and the upper clip piece.

In accordance with various exemplary embodiments, the finger is connected to the free end of the upper clip piece whose length is shortened by the length of the finger. The portion of the connection between the finger and the upper clip piece form a joint capable of performing a joint action. The portion of the hair clip toward its fore end is capable of holding the hair of the user by the finger in a gathered or in a bundled form safely.

In accordance with another exemplary embodiment, the concavity portion acts to provide an expanded hair holding space.

Another aspect of the present invention provides for a hair clip as discussed above in which the upper clip piece has a free end that defines a coil spring housing for housing a spring. The free end of the upper clip piece has a pair of connecting protrusions on opposite sides of the free end. The finger defines a pair of pin holes into which the connecting protrusions are disposed.

An additional aspect of the present invention resides in a hair clip as previously discussed in which the upper clip piece has a free end and a plate spring that extends from the central portion of the free end. The free end of the upper clip piece has a pair of connecting protrusions on opposite sides of the free end. The finger defines a pair of pin holes into which the connecting protrusions are disposed.

Another aspect of the present invention exists in a hair clip as discussed prior in which the rear portion of the finger is a Y-shaped diverging rear end portion.

A further aspect of the present invention is found in a hair clip as previously discussed in which the upper clip piece defines a hold eye. The rear end portion of the guide loop is located in the hold eye for use in preventing hair form entering the joint portion of the finger and upper clip piece.

The present invention also provides for in another aspect a hair clip in which the upper and lower clip pieces have a pair of brackets. The hinge pin and the coil spring are located at the brackets to form the pivot connection. In an additional aspect, the rear end portion of the guide loop is located on the same side of the brackets as the finger. In another aspect, the rear end portion of the guide loop is located on an opposite side of the brackets from the finger.

Another aspect of the present invention exists in a hair clip as described above in which a connecting means between the finger and the guide loop are connected with and separated from each other easily.

An additional aspect of the present invention is provided in a hair clip that has a lower clip piece and an upper clip piece connected through a pivot connection. The upper clip piece has a connecting portion that has a sliding groove. A finger is connected to the upper clip piece through a pivot connection. The finger is used for holding the hair of the user in a bundled state. A guide loop is connected to a rear end portion of the finger. The guide loop has a tip that is in sliding engagement with the sliding groove of the connecting portion.

A further aspect of the present invention exists in a hair clip as previously discussed in which the rear portion of the finger is a Y-shaped diverging rear end portion. A partially cut-open pin hole is formed on either side of the Y-shaped diverging rear end portion of the finger. The guide loop has a finger connecting portion on either side of the guide loop that defines a U-shaped indent into which the Y-shaped diverging rear end portion is inserted. The finger connecting portion has pins integrally formed with the guide loop and located in indents of the guide groove. The pins of the guide loop are disposed into the partially cut-open pin holes of the Y-shaped diverging rear end portion.

Another aspect of the present invention is found in a hair clip mentioned prior in which the upper clip piece has a bottom portion that defines a concavity portion. The concavity portion is used to define a hair holding space to hold the hair of a user in a bundled state.

The present invention provides in an additional aspect for a hair clip with a lower clip piece connected to an upper clip piece through a pivot connection. The upper clip piece has a bottom portion that defines a concavity portion for use in defining a hair holding space to hold the hair of a user in a bundled state. A finger is connected to the upper clip piece through a pivot connection. The finger is used for holding the hair of the user in a bundled state. A guide loop is connected to a rear end portion of said finger. The guide loop is used for preventing hair from entering a joint portion defined by the finger and the upper clip piece. The guide loop has a rear end portion that is at least partially disposed between the lower clip piece and the upper clip piece.

A further aspect of the present invention is found in a hair clip as immediately mentioned in which the guide loop is integrally formed with the Y-shaped diverging rear end portion of the finger. The guide loop has a connecting portion that is formed in a waved and curved shape for imparting flexibility thereto. This flexibility may act to prevent the guide loop from interfering with the joint action of the finger.

Another aspect of the present invention exists in a hair clip as immediately discussed in which the connecting portion is not waved and curved in shape but instead is straight in shape.

The hair clip in accordance with certain embodiments of the present invention is capable of gathering and holding the hair toward the inner portion of the clip pieces by the finger. Here, the finger is connected to the free end of the upper clip piece in such a way that it can perform a joint action, therefore, the hair clip can fix the hair in a desired beautiful style. Furthermore, the finger with its holding action increases the hair clipping force enabling the hair clips to clip the hair firmly. The hair clips are prevented from falling off by the movement of the user's head and body and safety is maintained while the hair clips are attached to the hair. The hair clip can clip the hair neatly in a gathered or a bundled form to fix the hair in various hair styles. The combination of the clipping force of an ordinary hair clip and the reinforced clipping force of the finger allows the hair clip in certain aspects to clip the hair more firmly, precluding the possibility of the hair clips from falling off from the head even if the user moves her head suddenly and rapidly.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which:

FIG. 1 is an exploded assembly view of a hair clip in accordance with one exemplary embodiment of the present invention. The connecting means of the finger and guide loop along with the concavity portion formed at the bottom of the upper clip piece are illustrated.

FIG. 1*a* is a partial exploded assembly view of the connecting means of the finger in accordance with another exemplary embodiment.

FIG. 1*b* is a partial exploded assembly view of the connecting means of the finger in accordance with another exemplary embodiment.

FIG. 2 is a perspective view of the hair clip in accordance with one exemplary embodiment in which the finger is connected with the upper clip piece and the guide loop is inserted through a hold eye formed in the upper clip piece.

FIG. 3 is a side view of the hair clip in accordance with one exemplary embodiment in which the guide loop is connected to the rear end portion of the finger and positioned exterior to the brackets of the hair clip.

FIG. 4 is a partial cross-sectional side view of the hair clip illustrating the clipping of the hair of a user in a gathered state.

FIG. 5 is a perspective view of the hair clip in another exemplary embodiment that shows the connecting portion of the guide loop, which is formed in an integral form at the rear end portion of the finger, in a waved and curved form to provide flexibility.

FIG. 6 is a perspective view of the hair clip in another exemplary embodiment that shows the connecting portion of the guide loop, which is formed in an integral form at the rear end portion of the finger, in a straight form.

FIG. 7 is a perspective view of the hair clip in another exemplary embodiment that shows a tip, which is formed at the guide loop connected to the rear end of the finger, connected to a sliding groove.

FIG. 8 is a partial exploded assembly view of the guide loop and the sliding groove of the exemplary embodiment of FIG. 7.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

FIG. 1, shows a hair clip (1) comprising a pair of clip pieces (2, 3) facing each other, a pressing plate (2*a*, 3*a*) formed integrally with each of said clip pieces (2, 3), brackets (2*b*, 3*b*) formed at edges of the pressing plates (2*a*, 3*a*), and a hinge pin (1*p*) to be inserted into pin holes (2*h*, 3*h*) of the brackets (2*b*, 3*b*) for connecting the clip pieces together. The hair clip (1) also has a coil spring (1*s*) inserted into the hinge pin (1*p*) to provide elastic force for the clip pieces (2, 3) for opening and closing. The aforementioned construction represents a basic construction of a hair clip in general.

In addition to the above known construction, the hair clip (1) of the present invention may include a finger (4) connected to the free end (2*e*) of the upper clip piece (2). The length of the upper clip piece (2) is shortened by the length of the finger (4) compared with the length of the lower clip piece (3). The finger (4) is connected to the upper clip piece (2) by insertion of a pin (2*p*) with a coil spring (2*s*) into the pin holes (2*h'*) of the brackets (2*d*) formed at the free end (2*e*) portion of the upper clip piece (2) and into the pin holes (4*h*) formed in the finger (4). The finger (4) is therefore pivoted with respect to the upper clip piece (2). At a Y-shaped diverging rear end portion (4*b*) of the finger (4) is a guide loop (5) connected by a connecting means to prevent the hair from entering the gap in the joint portion (L) of the finger (4). The rear end (5*b*) of the square-bent guide loop (5) is supported when arranged in certain positions in the hair clip (1). Further, teeth (4*t*) in a wave form are formed at the edges on both sides of the bottom portion of the finger (4) for use in holding hair.

The upper clip piece (2) has a laterally extending hold eye (2*g*) on the side of upper clip piece (2) close to the brackets (2*b*) for insertion of the guide loop (5). A concavity portion (2*c*) is formed at the bottom of the upper clip piece (2) to secure a hair clipping space. The remainder of the bottom portion has teeth (2*t*) in a wave form to hold the hair of the user.

The lower clip piece (3) is in a narrow, long form, and slightly curves in the longitudinal direction. The lower clip piece (3) is brought into contact with the end (4*a*) of the finger (4) at its fore end portion.

As a means to connect the guide loop (5) to the rear end portion (4*b*) of the finger (4), partially cut-open pin holes (4*g*) are provided. As shown in FIG. 1, the partially cut-open pin holes (4*g*) are at the Y-shape diverging rear end portion (4*b*) of the finger (4). At the connecting portion (5*a*) on either side of the guide loop (5) is a U-shaped indent (5*u*) into which the rear end portion (4*b*) of the finger (4) is inserted. A pin (5*p*) is provided in the indent (5*u*) in an integral form. The pins (5*p*) are pushed into the pin holes (4*g*) at the rear end portion (4*b*) of the finger (4) through the cut-open portion of the pin holes (4*g*). In this manner, the pins (5*p*) are connected smoothly with the pin holes (4*g*) by the elasticity of the material of the finger (4). After the connection, the connecting portions (5*a*) of the guide loop (5) do not fall off the rear end portion (4*b*) of the finger (4) unless manual force is applied to separate them.

The rear end portion (5*b*) of the guide loop (5), as shown in FIG. 2, is inserted through the hold eye (2*g*) provided in the form of a laterally extending hole in the upper clip piece (2). Therefore, without falling off the upper clip piece (2), the guide loop (5) moves flexibly in the hold eye (2*g*) according to the joint action of the finger (4). The guide loop (5) plays the role of preventing the hair from entering the gap between the joint portion (L) of the finger (4) and the upper clip piece (2). The guide loop (5) can be assembled to the hair clip (1) easily and conveniently by inserting the rear end portion (5*b*) of the guide loop (5) through the hold eye (2*g*) of the upper clip piece (2) using its connecting means.

The square bent rear end portion (5*b*) of the guide loop (5) connected to the rear end portion (4*b*) of the finger (4) may be positioned either at the A location in the interior or at the B location in the exterior of the brackets (2*b*, 3*b*) of the hair clip (1), as shown in FIG. 3. In either case, the guiding action of the guide loop (5) acts to prevent the hair from entering the joint portion (L) of the finger (4) in a similar manner.

Another example of a connecting means of the finger (4) in accordance with another exemplary embodiment of the present invention is shown in FIG. 1A. Here, a coil spring housing (2*f*) is formed at the free end (2*e*) of the upper clip piece (2) to house a coil spring (2*s*) therein in order to operate the finger (4) in an elastic manner. Connecting protrusions (2*p*) are formed on both sides of the free end (2*e*) of the upper clip piece (2) in such a way that the protrusions (2*p*) each protrude toward the exterior of the free end (2*e*) so that the connecting protrusions (2*p*) may be inserted into the connecting holes (4*h*) of the finger (4) enabling a joint action of the finger (4). In this manner, the finger (4) can be assembled to the free end (2*e*) of the upper clip piece (2) of the hair clip (1) through a simpler process thus making it possible to produce the hair clip in a more efficient manner.

A further example of a connecting means of the finger (4) in accordance with the present invention is explained as shown in FIG. 1B. Here, a plate spring (2*r*) extends from the center of the free end (2*e*) of the upper clip piece (2) for elastic operation of the finger (4). Connecting protrusions (2*p*) are formed on both sides of the free end (2*e*) of the upper clip piece (2) in such a way that the connecting protrusions (2) may protrude toward the exterior of the free end (2*e*). The connecting protrusions (2*p*) are inserted into the pin holes (4*h*) of the finger (4) to enable a joint action of the finger (4). In this embodiment, the plate spring (2*r*) replaces the coil spring (2*s*) in operating the finger (4) in an elastic manner. This arrangement acts to reduce the number of component parts, making it possible to assemble the finger (4) in a simpler manner for a more efficient assembly and production of the hair clip (1).

Another exemplary embodiment of the connecting means of the guide loop (5) is shown in FIG. 5. The guide loop (5) is formed integrally at the rear end portion (4*b*) of the finger (4) which is connected with the free end (2*e*) of the upper clip piece (2) of the hair clip (1). The connecting portion (5*a*) is formed in a waved, curved form to impart flexibility. The rear end (5*b*) of the guide loop (5) is positioned either in an A position in the interior of or in a B position in the exterior of the brackets (2*b*, 3*b*) of the hair clip when the finger (4) is assembled as previously mentioned with respect to FIG. 3. Positioning of the rear end (5*b*) of the guide loop (5) in either of these two alternative positions (A position or B position) brings forth the same smooth guide action for preventing the hair from entering the joint portion (L) of the finger (4). The flexibility provided by the wave and curve formation of the connecting portion (5*a*) of the guide loop (5) results in free variation of the length of the guide loop (5) from the joint action of the finger (4). This action helps preclude interference of the guide loop (5) in the operation of the finger (4).

FIG. 6 shows another exemplary embodiment of the connecting means of the guide loop (5) in accordance with the present invention. Here, the guide loop (5), which is formed integrally with the rear end portion (4*b*) of the finger (4), is straight in form at its connection portion (5*a*). The rear end portion (5*b*) of the guide loop (5) is positioned either in an A position in the interior of or in a B position in the exterior of the brackets (2*b*, 3*b*) of the hair clip (1) at the time when the finger (4) is assembled. Positioning of the rear end (5*b*) of the guide loop (5) in either of these two alternative positions (A position or B position) brings forth the same smooth guide action of preventing hair from entering the joint portion (L) of the finger (4).

The hair clip (1) of the present invention with its aforesaid construction opens, as shown in FIG. 2, when the pressing plates (2*a*, 3*a*) are manually pressed by hand. Here, the upper and the lower clip pieces (2, 3) together with the finger (4) open with the hinge pin (1*p*) as a supporting point. The lower clip piece (3) is then inserted into the hair of the user to hold the hair to be clipped between the upper and the lower clip pieces (2, 3). If the pressing plates (2*a*, 3*a*) are released, the upper and the lower clip pieces (2, 3) clip the hair (h) by pressing against each other by the elasticity of the coil spring (1*s*), as shown in FIG. 4. At the same time, the finger (4) performs an inward bent joint action at the free end (2*e*) of the upper clip piece (2) by the elasticity of the coil spring (2*s*). This arrangement holds the hair (h) in a gathered state as the end (4*a*) of the finger (4) is brought into contact with the fore end of the lower clip piece (3). As the bottom portion of the upper clip piece (2) is formed with a concavity portion (2*c*), the hair clipping space is expanded so as to hold the hair (h) in a gathered or bundled form easily.

As shown in FIGS. 7 and 8, another exemplary embodiment of the connecting means of the guide loop (5) is provided. At a portion above the brackets (2*b*) of the upper clip piece (2), a connecting portion (2*q*) is formed with a sliding groove (2*k*) provided on either side of the connecting portion (2*q*). Connected to connecting portion (2*q*) is a tip (5*t*) formed at the rear end of a V-shaped guide loop (5) which is connected with the finger (4). The connection between the finger (4) and the guide loop (5) is made as previously described in the exemplary embodiment of FIG. 1. As mentioned, an arrangement to connect the guide loop (5) to the rear end portion (4*b*) of the finger (4) includes partially cut-open pin holes (4*g*) at the Y-shape diverging rear end portion (4*b*) of the finger (4), as shown in FIG. 1., FIG. 7 and FIG. 8. At the connecting portion (5*a*) on either side of the guide loop (5) is a U-shaped indent (5*u*) into which the rear end portion (4*b*) of the finger (4) is inserted. Pins (5*p*) are provided in the indent (5*u*) in an integral form so that if the pins (5*p*) are pushed into the pin holes (4*g*) at the rear end portion (4*b*) of the finger (4) through the cut-open portion of the pin holes (4*g*), the pins (5*p*) are connected smoothly with the pin holes (4*g*) by the elasticity of the material of the finger (4).

Construction of this exemplary embodiment of the invention, with its simple and convenient process of assembling the guide loop (5), enables the hair clip (1) to be assembled and manufactured efficiently. As the tip (5*t*) at the rear end of the guide loop (5) is in sliding connection in the sliding groove (2*k*), the guide loop (5) moves flexibly during the operation of the finger (4). This arrangement leads to smooth operation of the finger (4), preventing the hair from entering the joint portion (L) of the finger (4).

As the hair is clipped firmly by the combination of the original clipping force of the upper and the lower clip pieces (2, 3) of the hair clip (1) and the reinforced clipping force of the finger (4), the hair clip (1) does not fall off the hair even by a sudden, rapid movement of the head, enabling the hair to maintain a beautiful style. Furthermore, the guide loop (5) does not interfere with the joint action of the finger (4) but performs the role of guidance preventing the hair clipped between the clip pieces (2, 3) from entering the joint portion (L) of the finger (4).

The hair clip (1) presently described can clip the hair of the user in more desired styles, maintain the clipped hair more firmly, and consequently provide a way to use the hair clip for various hair beauty purposes.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is

1. A hair clip comprising:

a lower clip piece;

an upper clip piece connected to said lower clip piece through a pivot connection, said upper clip piece having a bottom portion that defines a concavity portion for use in defining a hair holding space to hold the hair of a user in a bundled state, wherein said lower clip piece has a top surface that faces towards said upper clip piece, and wherein said lower clip piece has a bottom surface that faces away from said upper clip piece;

a finger connected to said upper clip piece through a pivot connection, said finger used for holding the hair of the user in a bundled state; and a guide loop connected to a rear end portion of said finger, said guide loop used for preventing hair from entering a joint portion defined by said finger and said upper clip piece, said guide loop having a rear end portion that is at least partially disposed between said lower clip piece and said upper clip piece, wherein the entire said guide loop is located above said bottom surface of said lower clip piece when said lower clip piece and said upper clip piece are in an unbundled state and not holding the hair of the user.

2. The hair clip as in claim 1, wherein said rear end portion of said finger is a Y-shaped diverging rear end portion, and wherein said guide loop is integrally formed with said Y-shaped diverging rear end portion of said finger, wherein said guide loop has a connecting portion that is formed in a waved and curved shape for imparting flexibility thereto.

3. The hair clip as in claim 1, wherein said rear end portion of said finger is a Y-shaped diverging rear end portion, and wherein said guide loop is integrally formed with said Y-shaped diverging rear end portion of said finger, and wherein said guide loop has a connecting portion that is straight in shape.

4. A hair clip comprising:

a lower clip piece having a top surface;

an upper clip piece connected to said lower clip piece through a pivot connection, wherein said upper clip piece has a bottom surface that faces said top surface of said lower clip piece;

a finger connected to said upper clip piece through a pivot connection; and a guide loop connected to a rear end portion of said finger, said guide loop having a rear end portion that is located between said lower clip piece and said upper clip piece such that said rear end portion directly faces said bottom surface of said upper clip piece and said top surface of said lower clip piece.

5. The hair clip as in claim 4, wherein said guide loop is integrally formed with said rear end portion of said finger.

6. The hair clip as in claim 5, wherein said guide loop has a connecting portion that is contiguous with said rear end portion of said finger and is integrally formed therewith, wherein said connecting portion has a waved and curved shape for imparting flexibility to said guide loop.

7. The hair clip as in claim 5, wherein said guide loop has a connecting portion that is contiguous with said rear end portion of said finger and is integrally formed therewith, wherein said connecting portion is straight in shape.

8. The hair clip as in claim 4, wherein said lower clip piece has a pressing plate and wherein said upper clip piece has a pressing plate, wherein said rear end portion of said guide loop is located between said pressing plate of said lower clip piece and said pressing plate of said upper clip piece.

9. The hair clip as in claim 4, wherein said lower clip piece has a pressing plate and wherein said upper clip piece has a pressing plate, wherein said pressing plate of said lower clip piece and said pressing plate of said upper clip piece are located on a side of said pivot connection connecting said lower clip piece and said upper clip piece, wherein said rear end portion of said guide loop is located on an opposite side of said pivot connection connecting said lower clip piece and said upper clip piece than said side at which said pressing plate of said lower clip piece and said pressing plate of said upper clip piece are located.

10. A hair clip comprising:

a lower clip piece;

an upper clip piece connected to said lower clip piece;

a finger connected to said upper clip piece by a pivot connection;

a spring at said pivot connection between said finger and said upper clip piece that urges both said finger and said upper clip piece in the same rotational direction about said pivot connection; and a guide loop connected to and integrally formed with a rear end portion of said finger, said guide loop used for preventing hair from entering a joint portion defined by said finger and said upper clip piece, said guide loop having a rear end portion that is located between said lower clip piece and said upper clip piece, wherein said finger and said guide loop define an opening bound by said finger and said guide loop.

11. The hair clip as in claim 10, wherein said rear end portion of said finger is a Y-shaped diverging rear end portion, and wherein said guide loop is integrally formed with said Y-shaped diverging rear end portion of said finger, wherein said guide loop has a connecting portion that is formed in a waved and curved shape for imparting flexibility thereto.

12. The hair clip as in claim 10, wherein said rear end portion of said finger is a Y-shaped diverging rear end portion, and wherein said guide loop is integrally formed with said Y-shaped diverging rear end portion of said finger, and wherein said guide loop has a connecting portion that is straight in shape.

13. The hair clip as in claim 10, wherein said lower clip piece has a pressing plate and wherein said upper clip piece has a pressing plate, wherein said rear end portion of said guide loop is located between said pressing plate of said lower clip piece and said pressing plate of said upper clip piece.

14. The hair clip as in claim 10, wherein said lower clip piece has a pressing plate and wherein said upper clip piece has a pressing plate, wherein said pressing plate of said lower clip piece and said pressing plate of said upper clip piece are located on a side of said connection connecting said lower clip piece and said upper clip piece, wherein said rear end portion of said guide loop is located on an opposite side of said connection connecting said lower clip piece and said upper clip piece than said side at which said pressing plate of said lower clip piece and said pressing plate of said upper clip piece are located.

* * * * *